US005660031A

United States Patent [19]

Clark

[11] Patent Number: 5,660,031

[45] Date of Patent: Aug. 26, 1997

[54] METHOD AND APPARATUS FOR TRAINING HORSES

[76] Inventor: Don M. Clark, 14078 State Hwy. 110 North, Tyler, Tex. 75704

[21] Appl. No.: 524,003

[22] Filed: Sep. 5, 1995

[51] Int. Cl.[6] ..... B68B 1/00

[52] U.S. Cl. ..... 54/71; 54/24

[58] Field of Search ..... 54/24, 36, 71

[56] References Cited

U.S. PATENT DOCUMENTS

| | | | |
|---|---|---|---|
| 3,731,456 | 5/1973 | Hill | 54/24 |
| 4,495,753 | 1/1985 | Simpson | 54/24 |
| 4,589,248 | 5/1986 | Ruddock et al. | 54/24 |

*Primary Examiner*—Robert P. Swiatek

*Attorney, Agent, or Firm*—Zarley, McKee, Thomte Voorhees & Sease; Mark D. Frederiksen

[57] ABSTRACT

An animal training apparatus includes an elongated main cord with an enlarged member connected to each end thereof. A pair of pressure beads are connected to the cord proximal to and spaced equidistant from a median point on the cord. A pair of pressure beads are slidably connected to the cord on opposing sides of the median point. A pair of attachment members each have a loop portion slidably threaded onto the cord with hook members projecting from the loops. The pressure members may also include magnets, creating a magnetic field surrounding the pressure beads. In the method of the invention, the main cord is placed over the horse's head with the pressure beads located directly behind the horse's ears and the median point of the cord centered between the horse's ears. The attachment members are connected to cheek rings on a halter on the horse's head such that the enlarged members of the cord hang below the cheek rings of the halter. A lead strap connected to the halter is grasped in one hand, while the hitched members on the free ends of the pull cords are grasped in the other hand. A trainer gradually applies pressure to the pressure beads by pulling downwardly on the pull cords, maintaining the pressure on the main cord until the horse yields and lowers his head. The trainer then partially releases pressure on the cords, subsequently reapplying pressure until the horse again yields to the reapplied pressure.

24 Claims, 1 Drawing Sheet

METHOD AND APPARATUS FOR TRAINING HORSES

TECHNICAL FIELD

The present invention relates generally to equine training, and more particularly to an improved method and apparatus for training a horse to be submissive to a trainer.

BACKGROUND OF THE INVENTION

The horse has had a major place in society as a domestic pleasure animal for many years. However, one of the most difficult aspects in dealing with a horse is maintaining "control" over the horse, so that the horse remains responsive and manageable to trainer commands and instructions. While there are a variety of training methods and apparatus known throughout the world for training a horse, current methods and apparatus suffer several drawbacks. Most apparatus for controlling horses utilize restraints or harnesses of some type which engage the head or mouth, or both. With such apparatus, the trainer must physically overpower an uncooperative animal. Many times the rider will utilize other accessories items in such training. For example, a bit in the horse's mouth is frequently utilized to control the animal. A riding crop or whip may also be utilized in maintaining the attention of the horse during a training method.

The small or young rider is not always capable of utilizing the physical force necessary to train a horse utilizing conventional methods and apparatus for controlling a horse. In addition, a bit, and other various accessories utilized to control a horse can cause pain to the animal.

SUMMARY OF THE INVENTION

It is therefore a general object of the present invention to provide an improved method and apparatus for training a horse to be more manageable and responsive to the trainer.

Another object of the present invention is to provide a training apparatus which does not require great physical strength to control a horse.

A further object is to provide a training apparatus which is simple to use and economical to manufacture.

A further object of the present invention is to provide a training apparatus which will not hurt the animal yet will permit control of the animal.

Still another object of the present invention is to provide a method for training a horse which is simple to learn and apply.

These and other objects will be apparent to those skilled in the art.

The animal training apparatus of the present invention includes an elongated main cord with an enlarged member connected to each end thereof. A pair of pressure beads are connected to the cord proximal to and spaced equidistant from a median point on the cord. Preferably, a pair of pressure beads are slidably connected to the cord on opposing sides of the median point, and maintain within a predetermined sliding range by upper and lower stop beads affixed to the cord. A pair of attachment members each have a loop portion slidably threaded onto the cord with hook members projecting from the loops. Each attachment member is slidably connected to the cord at each end, between the enlarged member and the pressure beads on each end of the cord. In the preferred embodiment of the invention, an elastic pull cord connects the enlarged members to the free ends of the main cord. The pressure members may also include magnets, creating a magnetic field surrounding the pressure beads. In the method of the invention, the main cord is placed over the horse's head with the pressure beads located directly behind the horse's ears and the median point of the cord centered between the horse's ears. The attachment members are connected to cheek rings on a halter on the horse's head such that the enlarged members of the cord hang below the cheek rings of the halter. A lead strap connected to the halter is grasped in one hand, while the enlarged members on the free ends of the pull cords are grasped in the other hand. A trainer gradually applies pressure to the pressure beads by pulling downwardly on the pull cords, maintaining the pressure on the main cord until the horse yields and lowers his head. The trainer then partially releases pressure on the cords, subsequently reapplying pressure until the horse again yields to the reapplied pressure. This procedure is repeated a number of times, until the horse lowers the head to the ground or sufficient progress is made in the training.

DESCRIPTION OF THE PREFERRED EMBODIMENT

Figure 1:
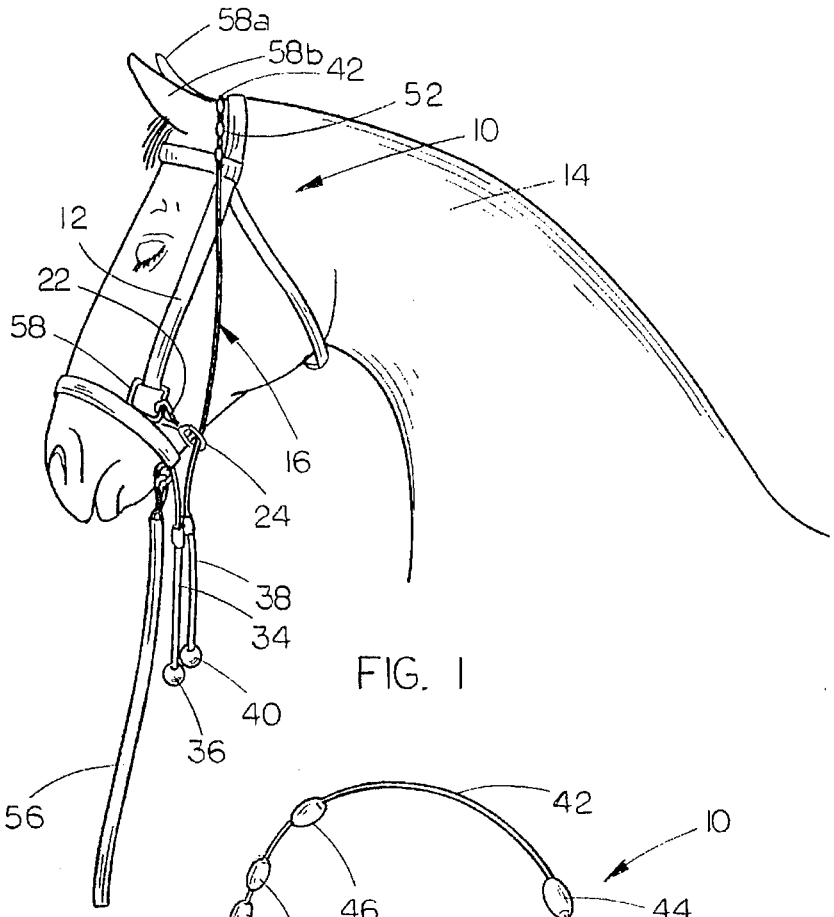
FIG. 1 is a perspective view of the training apparatus of the present invention utilized on a horse.

Referring now to the drawings, in which similar or corresponding parts are identified with the same reference numeral, and more particularly to FIG. 1, the horse training apparatus of the present invention is designated generally at 10 and is shown attached to a halter 12 on a horse's head 14.

Figure 2:
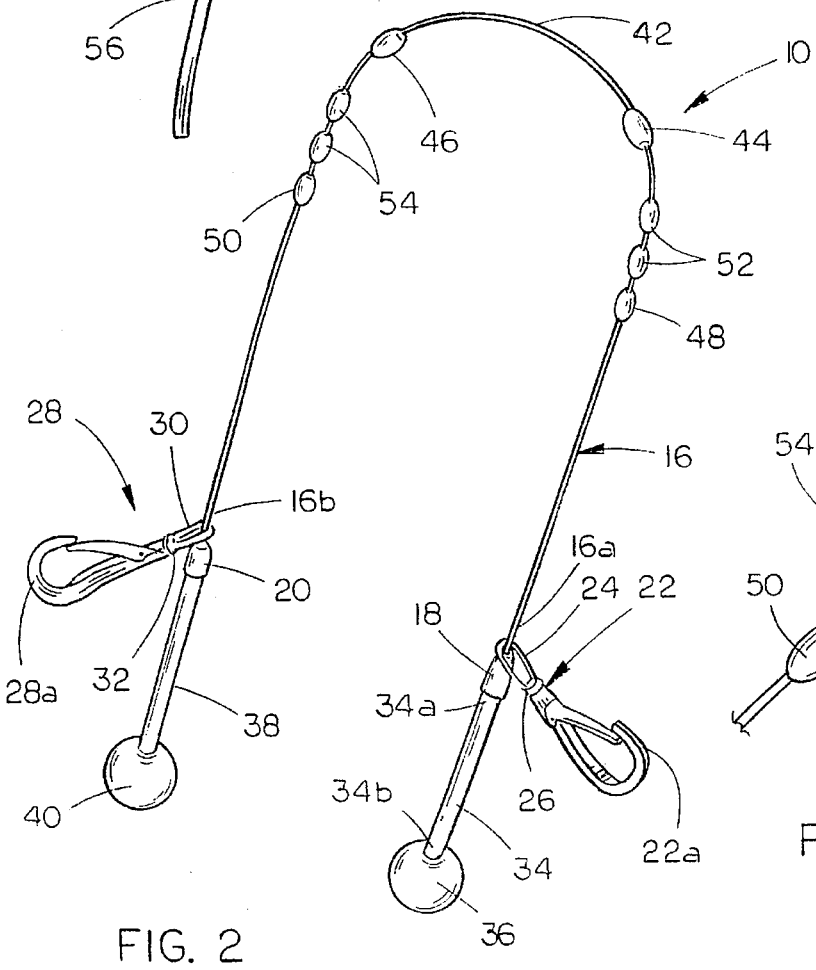
FIG. 2 is an enlarged perspective view of the horse training apparatus.

Referring now to FIG. 2, horse training apparatus 10 includes a cord 16 having an enlarged stop 18 formed at a first end 16*a* and a second stop 20 affixed to the second end 16*b*. A first swivel snap 22 has the loop 24 of the swivel base 26 threaded on cord 16, adjacent stop 18, to permit slidable movement of swivel snap 22 along cord 16. A second swivel snap 28 has its loop 30 of the swivel base 32 threaded on cord 16 adjacent stop 20, for slidable movement along cord 16. The snap portions 22*a* and 28*a* of swivel snaps 22 and 28 may be releasably attached to halter 12, as described in more detail hereinbelow.

A pull cord 34 has an upper end 34*a* affixed to stop 18, and an enlarged ball 36 affixed to a lower end 34*b*. Preferably, pull cord 34 is a stretchable elastic material such as rubber. A second pull cord 38 is attached to stop 20 in a similar fashion, and has a second ball 40 affixed to its lower end. Second pull cord 38 is also preferably formed of an elastic material. On the other hand, cord 16 is preferably formed of an inelastic material.

Cord 16 has a median point designated at 42 midway between stops 18 and 20. A first pair of upper stop beads 44 and 46 are spaced equidistant from median point 42 and affixed to cord 16 to maintain a position approximately two inches from median point 42. A pair of lower stop beads 48 and 50 are spaced away from upper stop beads 44 and 46 an equal distance, towards stops 18 and 20 respectively. Stop beads 48 and 50 are approximately three inches from upper stop beads 44 and 46, and are fixed in position on cord 16.

A first pair of pressure beads 52 are slidably mounted on cord 16 to slide between upper and lower stop beads 44 and 48. A second pair of pressure beads 54 are slidably mounted on cord 16 between upper and lower stop beads 46 and 50.

Referring once again to FIG. 1, the method for training a horse will be discussed in more detail. First, it is preferable that the horse have a halter 12, with a lead strap 56, attached to the horse's head 14. Training apparatus 10 is then placed over the horse's head directly behind the horse's ears 58 with the median point 42 centered between the horse's ears 58*a* and 58*b*. The cord 16 should not be located on halter 12, but rather should be in contact with the horse's flesh forward of the halter.

Apparatus 10 should be positioned with each pair of pressure beads 52 and 54 located over the depression, or poll, directly behind the horse's ears, on opposing sides of the horse's head 14. The location of pressure beads 52 and 54 is critical to the operation of the invention.

Swivel snaps 22 and 28 are then attached to each cheek ring 58 on the halter 12, proximal the horse's mouth. This permits pull cords 34 and 38 to hang directly below the horse's mouth and cord 16 slidable through the swivel snap loops 24 and 30.

While holding lead strap 56 in one hand, both balls 36 and 40 should be grasped in the other hand. Pressure is gradually applied on pressure beads 52 and 54 by slowly pulling down on balls 36 and 40. A slow gradual increase in pressure should be utilized in pulling down on balls 36 and 40. This pressure is maintained for 15–20 seconds, or until you feel the horse yielding to the pressure by lowering its head.

Each time the horse yields, pressure should be reduced and then reapplied in an attempt to persuade the horse to lower its head a little farther during each application of pressure. The "treatment" of repetitive applications of pressure is continued for five to seven minutes. The training apparatus 10 is then removed from the horse.

Each "training session" will cause a horse to lower its head more easily and more quickly towards the ground, until it takes very little pressure to accomplish this goal. It is believed that this position has a calming effect on the horse, since it is the same position that a horse utilizes in grazing—a time when the horse is calm and unafraid. The trainer should notice that the horse will become more responsive or submissive to the trainer's commands, and therefore becomes more manageable, less head shy, more calm, and will accept further commands and additional instruction or training more readily. Thus, the training session will affect the horse physiologically, to reinforce the notion that the trainer is dominant and in control. Occasional additional use of the training apparatus and method will reinforce previous training, and thereby be a constant reminder that the trainer is in control and should maintain the horse's responsiveness and submissiveness to the trainer.

Figure 3:
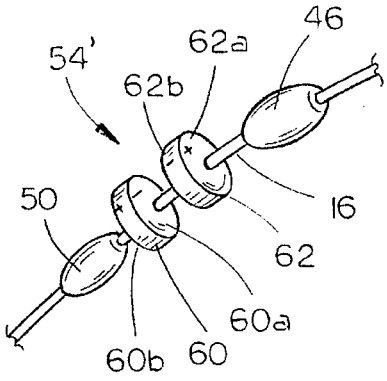
FIG. 3 is a super enlarged view of a second embodiment of the pressure beads of the training apparatus.

Referring now to FIG. 3, a second embodiment of the invention utilizes a different type of pressure beads to apply pressure to the horse's head. Because pressure beads 52 are identical to pressure beads 54, only pressure beads 54 are shown in detail in FIG. 3. Preferably, the second embodiment of pressure beads 54' utilize a pair of generally disk shaped magnets 60 and 62 threaded on cord 16 between upper and lower stop beads 46 and 50. Each magnet 60 and 62 has an opposing pole at opposite ends 60*a* and 60*b*, and 62*a* and 62*b*. As shown in FIG. 3, like poles of magnets 60 and 62 are located facing one another such that the magnetic fields of magnets 60 and 62 bias the magnets away from one another.

The inventor has found that the magnetic fields produced by magnets 60 and 62 have a more dynamic and pronounced effect when horse training apparatus 10 is utilized in the training session described above.

Whereas the invention has been shown and described in connection with the preferred embodiment thereof, many modifications, substitutions and additions may be made which are within the intended broad scope of the appended claims.

I claim:

1. Animal training apparatus, comprising:

an elongated main cord having first and second ends and a median point midway between the ends;

a first enlarged member connected to the cord first end;

a second enlarged member connected to the cord second end;

a first pressure bead, having a diameter greater than the diameter of the cord, connected to the cord intermediate the median point and the first end;

a second pressure bead, having a size substantially the same as the first pressure bead, connected to the cord intermediate the median point and the second end, and spaced from the median point substantially the same distance as the first pressure bead is spaced from the median point;

a first elongated pull cord connected between the main cord first end and the first enlarged member, formed of an elastic material having longitudinal stretchability; and a second elongated pull cord connected between the main cord second end and the second enlarged member, formed of an elastic material having longitudinal stretchability.

2. The animal training apparatus of claim 1, wherein said main cord is formed of a generally inelastic material.

3. The animal training apparatus of claim 1, further comprising:

a first attachment member slidably connected to the main cord between the first pressure bead and the first enlarged member;

said first attachment member having a hook member thereon for removable connection to a halter cheek ring; and a second attachment member slidably connected to the main cord between the second pressure bead and the second enlarged member;

said second attachment member having a hook member thereon for removable connection to a halter cheek ring.

4. The animal training apparatus of claim 3, wherein each attachment member includes a loop through which the main cord is slidably journaled, the loops having diameters less than diameters of the pressure beads and enlarged members, for slidable movement therebetween.

5. The animal training apparatus of claim 4, wherein each attachment member loop is mounted on a swivel base and each hook member is rotatably connected to the associated swivel base.

6. The animal training apparatus of claim 3, further comprising:

a first pair of stop beads affixed to the main cord on opposite sides of the first pressure bead;

said first pressure bead slidably mounted on the main cord; and a second pair of stop beads affixed to the main cord on opposite sides of the second pressure bead;

said second pressure bead slidably mounted on the main cord.

7. The animal training apparatus of claim 6, wherein said first and second pressure beads are magnets, with magnetic fields emanating therefrom.

8. The animal training apparatus of claim 3, wherein said first and second pressure beads are magnets, with magnetic fields emanating therefrom.

9. The animal training apparatus of claim 1, further comprising:

a first pair of stop beads affixed to the main cord on opposite sides of the first pressure bead;

said first pressure bead slidably mounted on the main cord; and a second pair of stop beads affixed to the main cord on opposite sides of the second pressure bead;

said second pressure bead slidably mounted on the main cord.

10. The animal training apparatus of claim 9, further comprising:

a third pressure bead, substantially equal in size to the first pressure bead, slidably mounted on the main cord between the first pair of stop beads; and a fourth pressure bead, substantially equal in size to the second pressure bead, slidably mounted on the main cord between the second pair of stop beads.

11. The animal training apparatus of claim 1, wherein said first and second pressure beads are magnets, with magnetic fields emanating therefrom.

12. Animal training apparatus, comprising:

an elongated main cord having first and second ends and a median point midway between the ends;

a first enlarged member connected to the cord first end;

a second enlarged member connected to the cord second end;

a first pressure bead, having a diameter greater than the diameter of the cord, connected to the cord intermediate the median point and the first end;

a second pressure bead, having a size substantially the same as the first pressure bead, connected to the cord intermediate the median point and the second end, and spaced from the median point substantially the same distance as the first pressure bead is spaced from the median point;

a first attachment member slidably connected to the main cord between the first pressure bead and the first enlarged member;

said first attachment member having a hook member thereon for removable connection to a halter cheek ring; and a second attachment member slidably connected to the main cord between the second pressure bead and the second enlarged member;

said second attachment member having a hook member thereon for removable connection to a halter cheek ring.

13. The animal training apparatus of claim 12, wherein each attachment member includes a loop through which the main cord is slidably journaled, the loops having diameters less than diameters of the pressure beads and enlarged members, for slidable movement therebetween.

14. The animal training apparatus of claim 13, wherein each attachment member loop is mounted on a swivel base and each hook member is rotatably connected to the associated swivel base.

15. The animal training apparatus of claim 12, further comprising:

a first pair of stop beads affixed to the main cord on opposite sides of the first pressure bead;

said first pressure bead slidably mounted on the main cord; and a second pair of stop beads affixed to the main cord on opposite sides of the second pressure bead;

said second pressure bead slidably mounted on the main cord.

16. The animal training apparatus of claim 15, further comprising:

a third pressure bead, substantially equal in size to the first pressure bead, slidably mounted on the main cord between the first pair of stop beads; and a fourth pressure bead, substantially equal in size to the second pressure bead, slidably mounted on the main cord between the second pair of stop beads.

17. The animal training apparatus of claim 15, wherein said first and second pressure beads are magnets, with magnetic fields emanating therefrom.

18. Animal training apparatus, comprising:

an elongated main cord having first and second ends and a median point midway between the ends;

a first enlarged member connected to the cord first end;

a second enlarged member connected to the cord second end;

a first pressure bead, having a diameter greater than the diameter of the cord, connected to the cord intermediate the median point and the first end;

a second pressure bead, having a size substantially the same as the first pressure bead, connected to the cord intermediate the median point and the second end, and spaced from the median point substantially the same distance as the first pressure bead is spaced from the median point;

a first pair of stop beads affixed to the main cord on opposite sides of the first pressure bead;

said first pressure bead slidably mounted on the main cord; and a second pair of stop beads affixed to the main cord on opposite sides of the second pressure bead;

said second pressure bead slidably mounted on the main cord.

19. The animal training apparatus of claim 18, further comprising:

a third pressure bead, substantially equal in size to the first pressure bead, slidably mounted on the main cord between the first pair of stop beads; and a fourth pressure bead, substantially equal in size to the second pressure bead, slidably mounted on the main cord between the second pair of stop beads.

20. The animal training apparatus of claim 19, wherein said first, second, third and fourth pressure beads are individual magnets emanating magnetic fields.

21. The animal training apparatus of claim 20, wherein said magnets each have opposing magnetic poles at opposing longitudinal ends, wherein the first and third pressure beads have like poles adjacent one another, and wherein the second and fourth pressure beads have like poles adjacent one another.

22. Animal training apparatus comprising:

an elongated main cord having first and second ends and a median point midway between the ends;

a first enlarged member connected to the cord first end;

a second enlarged member connected to the cord second end;

a first pressure bead, having a diameter greater than the diameter of the cord, connected to the cord intermediate the median point and the first end; and a second pressure bead, having a size substantially the same as the first pressure bead, connected to the cord intermediate the median point and the second end, and spaced from the median point substantially the same distance as the first pressure bead is spaced from the median point;

wherein said first and second pressure beads are magnets, with magnetic fields emanating therefrom.

23. A method for training a horse to be more submissive and responsive to a trainer's instruction, comprising the steps of:

haltering a horse with a halter of the type having a cheek ring on opposing sides of the horse's head;

attaching one end of a lead strap to the halter, the lead strap having a second free end;

placing a training apparatus main cord over the head of the horse and locating a median point of the cord directly behind the horse's ears and centered therebetween;

locating the main cord such that pressure beads on opposing sides of the median point of the cord are located behind each of the horse's ears in contact with the horse's head;

fastening first and second attachment members, which are slidably journaled along opposite ends of the main cord, to each halter cheek ring such that free ends of the cord hang downwardly from the cheek rings;

grasping the free end of the lead strap in one hand and the free ends of the cord in the other hand;

gradually applying pressure to the pressure beads on the horse's neck by pulling downwardly on the cord ends;

maintaining the pressure on the cord for a predetermined period of time, and then partially releasing pressure on the cord;

reapplying pressure on the cord for a predetermined period of time, and then again partially releasing pressure on the cord; and repeating the step of reapplying pressure and partially releasing pressure, a predetermined number of times.

24. The method of claim 23, wherein the predetermined period of time for applying pressure on the cord is the amount of time until the horse yields to the pressure and partially lowers the head.

* * * * *